US010974416B2

(12) United States Patent
Thorp

(10) Patent No.: US 10,974,416 B2
(45) Date of Patent: Apr. 13, 2021

(54) BUILDING COMPONENT OF A SETTABLE MATERIAL, WITH A PLURALITY OF FACING MEMBERS PROVIDED ON A FACE THEREOF, AND METHOD OF FORMING A BUILDING COMPONENT

(71) Applicant: Harvey Richard Thorp, Newcastle-Under-Lyme (GB)

(72) Inventor: Harvey Richard Thorp, Newcastle-Under-Lyme (GB)

( * ) Notice: Subject to any disclaimer, the term of this patent is extended or adjusted under 35 U.S.C. 154(b) by 0 days.

(21) Appl. No.: 16/461,362

(22) PCT Filed: Aug. 23, 2017

(86) PCT No.: PCT/GB2017/052480
§ 371 (c)(1),
(2) Date: May 15, 2019

(87) PCT Pub. No.: WO2018/051061
PCT Pub. Date: Mar. 22, 2018

(65) Prior Publication Data

US 2019/0299488 A1 Oct. 3, 2019

(30) Foreign Application Priority Data

Sep. 13, 2016 (GB) ..... 1615492

(51) Int. Cl.
*B28B 19/00* (2006.01)
*E04G 9/10* (2006.01)

(52) U.S. Cl.
CPC ..... *B28B 19/0061* (2013.01); *E04G 9/10* (2013.01)

(58) Field of Classification Search
CPC ..... B28B 19/0053; B28B 19/0061; B28B 19/0085; B28B 19/0084; E04G 9/10
USPC ..... 264/35; 249/15
See application file for complete search history.

(56) References Cited

U.S. PATENT DOCUMENTS 2,178,535 A * 10/1939 Willson ..... B28B 19/0061 264/277
5,009,387 A * 4/1991 Scott ..... B28B 19/0061 249/112
6,257,545 B1 * 7/2001 Tokita ..... B28B 19/0061 249/15

FOREIGN PATENT DOCUMENTS

| | | |
|---|---|---|
| GB | 1439282 A | 6/1976 |
| GB | 2422620 A | 8/2006 |
| JP | S6259760 | 7/2001 |
| WO | 2006079835 A1 | 8/2006 |

OTHER PUBLICATIONS

PCT Application No. PCT/GB2017/052480, International Search Report and Written Opinion, dated Nov. 22, 2017.
United Kingdom Application No. GB1615492.4, Search Report dated Nov. 28, 2016, 2 pages.

* cited by examiner

*Primary Examiner* — Michael Safavi
(74) *Attorney, Agent, or Firm* — Han Santos, PLLC

(57) ABSTRACT

Apparatus (10) usable in forming a building component of a settable material such as concrete with a plurality of facing members (24) such as bricks. The apparatus comprises a base member (12) in the form of a steel plate with a regular array of mounting holes (14) which can receive clip members (26) to support the facing members (24) in position during casting of the concrete.

42 Claims, 5 Drawing Sheets

BUILDING COMPONENT OF A SETTABLE MATERIAL, WITH A PLURALITY OF FACING MEMBERS PROVIDED ON A FACE THEREOF, AND METHOD OF FORMING A BUILDING COMPONENT

This invention concerns apparatus usable in forming a building component of a settable material, with a plurality of facing members provided on at least one face of the building component, and a method of forming such a building component.

Increasingly in construction, panels are being used made from a settable material such as concrete with a plurality of facing members such as bricks, tiles, stone or other materials. Such panels may be for instance cladding panels or structural wall panels. These panels may provide the appearance of conventional brickwork, but relative to traditional bricklaying and other conventional building methods, using such panels provides significant advantages and especially when working at height. Techniques such as bricklaying or other operations need not be carried out at potentially hazardous locations. Also such panels can be formed off site if required.

Difficulties can however be encountered in producing such panels. The facing members have to be accurately located and held in position during location of the settable material in a mould, and during setting of the material. There are however often size variations in the facing members, and particularly when they are formed by firing. A good bond between the settable material and facing members is required, but it is generally undesirable for the settable material to reach the front face of the facing members.

Accordingly a number of techniques have been used to prevent the settable material reaching the front face of the facing members. One arrangement is to use sand to fill the spaces between the facing members to a required depth. This is generally though only possible if the moulds are lying horizontally. With this technique it is necessary to remove the sand after moulding, and this is not always a straightforward task.

Other techniques have included gluing the facing members to the mould and using perhaps a sealant between the facing members. This does not always work particularly well, and especially if it is not possible to fully dry the facing members. Such facing members are often cut prior to use for instance using water cooled blades which will lead to the products being wet. Again such materials are required to be removed post moulding, which again may not be a straightforward task.

In many panels a variation may be required across the panel, for instance to receive a window or other structure. Also the panels may not always require to be flat and may require to provide a corner or other structure. Once the panel is formed it is desirable for as little post moulding work to be carried out as possible, such as cleaning, pointing or otherwise working on particularly the front face of the panel.

According to a first aspect of the invention there is provided apparatus usable in forming a building component of a settable material, with a plurality of facing members provided on at least one face of the building component, the apparatus including a base member which can form part of a mould, the base member being in the form of a sheet of material with a regular array of through holes, a plurality of clip members each with a body engageable in a required one of the through holes to retain the respective clip member in position, each clip member also having a head engageable against a facing member to urge the facing member against the base member, and to hold the facing member in position in a mould whilst a settable material is located in the mould and sets, such that a building component is formed with the facing members attached to the set material.

The base member may include a plurality of non-circular cross-sectional facing member mounting holes to receive the clip member bodies in a required orientation, and said base member mounting holes may be rectangular and may be square in cross section, or may be in the form of slots.

The clip member may have first and second opposite support faces engageable against respective adjacent facing members, and the first support face may be significantly more rigid than the second support face, such that the first support face can provide a datum for locating the facing members, and the second support face can accommodate tolerances in the size of the facing members.

The first and second support faces may be provided by opposite spaced strips, with an interconnecting web, which web may be inclined towards the clip member head and the first support face.

A further interconnecting web may be provided extending between the first and second support faces, and the further interconnecting web may be on the opposite side of the inclined web to the clip member head.

The clip member head may be resilient, and may extend outwardly respectively from each of the support faces. The clip member head may be curved, and can flatten out against the facing members when the clip member is urged into the base member.

One or more clip members may be formed with heads at different spacings from the body and/or adjustable spacings from the body, to permit different thicknesses of facing members to be mounted adjacent each other.

The clip member body may include one or more engagement formations engageable against the base member to retain the clip member on the base member.

A plurality of engagement formations may be provided on the clip member to provide retaining of the clip member at a required position on the base member, and the spacing of the engagement formations may be such that the clip member head can flex to a greater extent against a facing member as the clip member is moved into the base member than said spacing. The engagement formations may be in the form of serrations or barbs.

The clip members may include a frangible formation such that following setting of the settable material, the clip members can break to release the building component from the base member.

The frangible formation may be in the form of a partial cut or a line of weakness, extending across the clip member, and the frangible formation may extend across the first and second support faces spaced from the clip member head.

A sealing member may be provided extendable between the facing members adjacent the base member, to prevent a settable material from passing between the facing members.

The sealing member may be in the form of a resilient elongate member which in a relaxed condition is wider than the spacing between the formations, but can be compressed to locate between the facing members in a friction fit. The sealing member may be of a lesser thickness than the depth of the facing members.

The sealing member may be made of polyethylene which may be circular in cross section.

In one embodiment at least some of the clip members and the sealing member are integrally formed.

The base member may also include visible markings to assist correct location of the facing members thereon. The base member may be in the form of a steel plate.

The base member may also include a plurality of mould mounting holes, which holes may be circular in cross section, may be larger than the facing member mounting holes, and/or may be located between and spaced from the facing member mounting holes.

The apparatus may include one or more mould members connectable to the base member to define a mould for the settable material to be located in, with the base member defining at least one face of the mould. The mould members may be modular.

One or more connecting bars may be provided extending between the mould members and the base member, and the mould members and/or connecting bars may be mountable to the mould mounting holes of the base member.

The clip members may include formations to mount reinforcement and/or insulation or other components, such that these can be located within the building component.

According to a further aspect of the invention there is provided a method of forming a building component of a settable material, with a plurality of facing members provided on at least one face of the building component, the method including mounting a plurality of facing members on a base member using apparatus according to any of the preceding twenty paragraphs, forming a mould incorporating the base member, locating a settable material in the mould, once the settable material has set removing the formed building component from the mould including breaking the clip members extending between the facing members and the base member.

In one arrangement a retarded mortar is provided between the facing members adjacent the base member, and the retardation of the mortar is such that the mortar will not fully cure until after setting of the settable material, such that the mortar can be worked further if required following settling of the settable material of the building component.

The building component may include reinforcement and/or insulation, which reinforcement and/or insulation may be mounted to the clip members prior to location of the settable material in the mould.

The settable material may be concrete.

The facing members may be any of bricks, tiles, stones, brick slips or terracotta.

The base member may extend vertically during mounting of the facing members thereon and/or during location of the settable material in a mould.

Embodiments of the present invention will now be described by way of example only and with reference to the accompanying drawings, in which.

The drawings show apparatus 10 for forming a building component for instance of concrete with a plurality of facing members such as bricks, tiles or stones mounted on a face of the concrete to provide for instance the appearance that these have been laid in a conventional manner, and give the appearance for instance of a conventional brick wall. When bricks are used, these would generally be of reduced thickness relative to conventional bricks, and could be produced for instance by cutting conventional bricks in half, to provide two brick facing members of half width relative to conventional bricks.

Figure 6:
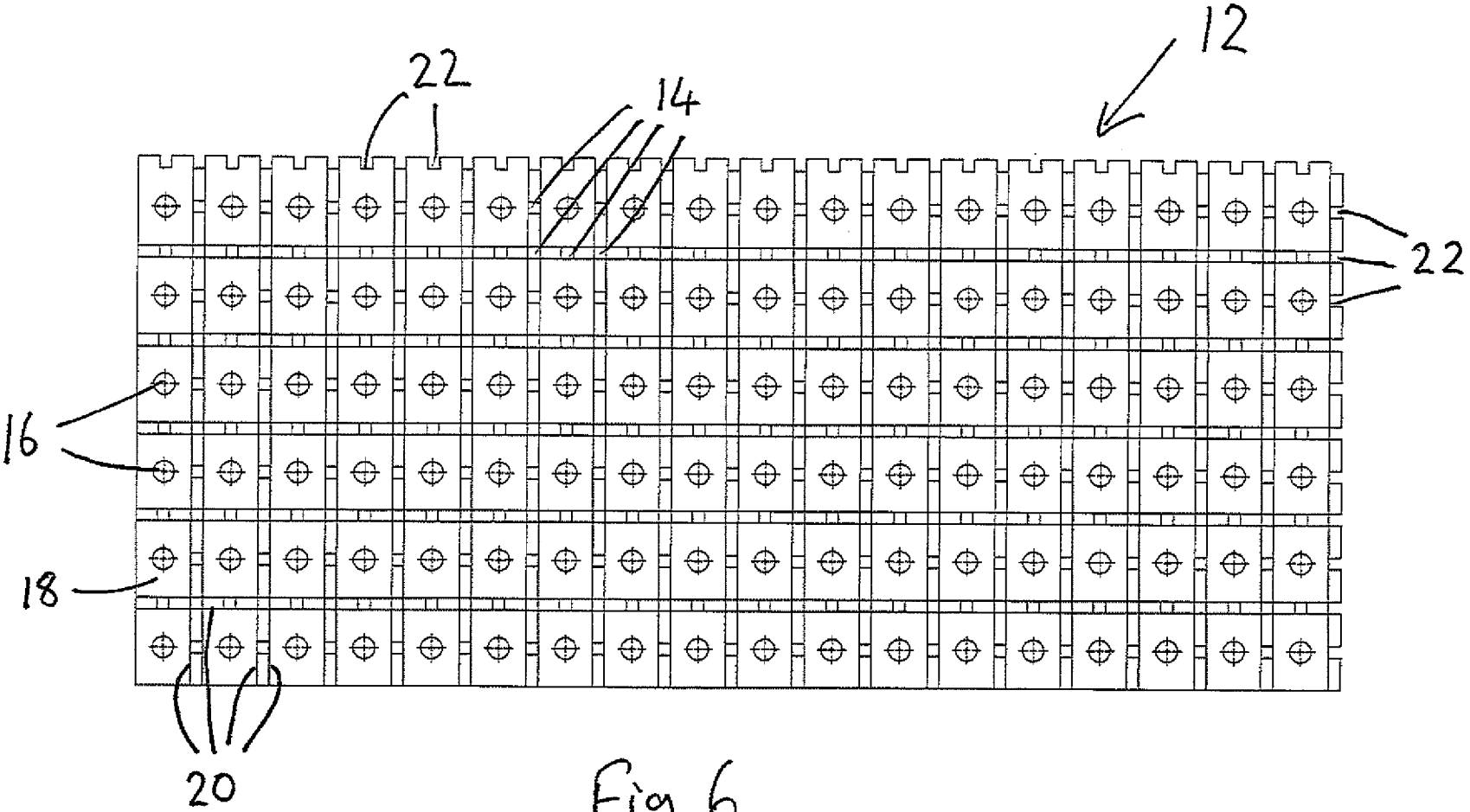
FIG. 6 is a diagrammatic front view of a further component according to the invention.

The apparatus 10 includes a base member 12 in the form of a steel plate with a regular array of through holes. The through holes include square cross sectional facing member mounting holes 14, and circular cross section mould mounting holes 16. The facing member mounting holes 14 are equispaced from each other in pairs of offset lines to define rectangular spaces 18 therebetween, which as shown in FIG. 6 are taller than they are wide. The mould mounting holes 16 which are larger than the facing member mounting holes 14, are provided centrally within the rectangular spaces.

Visible etched or otherwise marking lines 20 are provided interconnecting the respective edges of the facing member mounting holes 14. Castellated recesses 22 are provided along the top and one side edge of the base member 12, to facilitate mounting of the base member 12 to other such base members 12 or other components to form a mould.

A plurality of facing members 24 which in this instance are bricks of reduced thickness relative to conventional bricks, and may be half thickness bricks, can be mounted on the base member 12 by a plurality of clip members 26.

Figure 5:
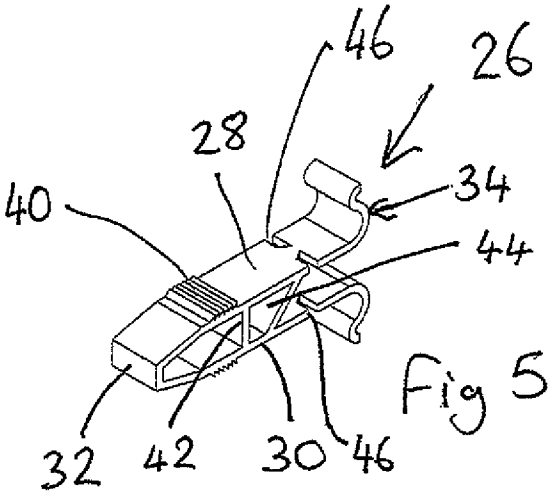
FIG. 5 is a diagrammatic perspective view of a component usable in the invention.
Figure 4:
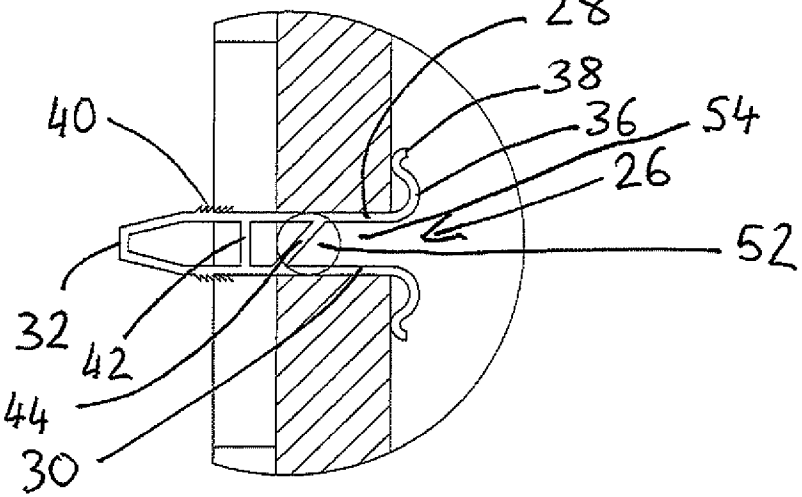
FIG. 4 is an enlarged part of FIG. 3.
Figure 3:
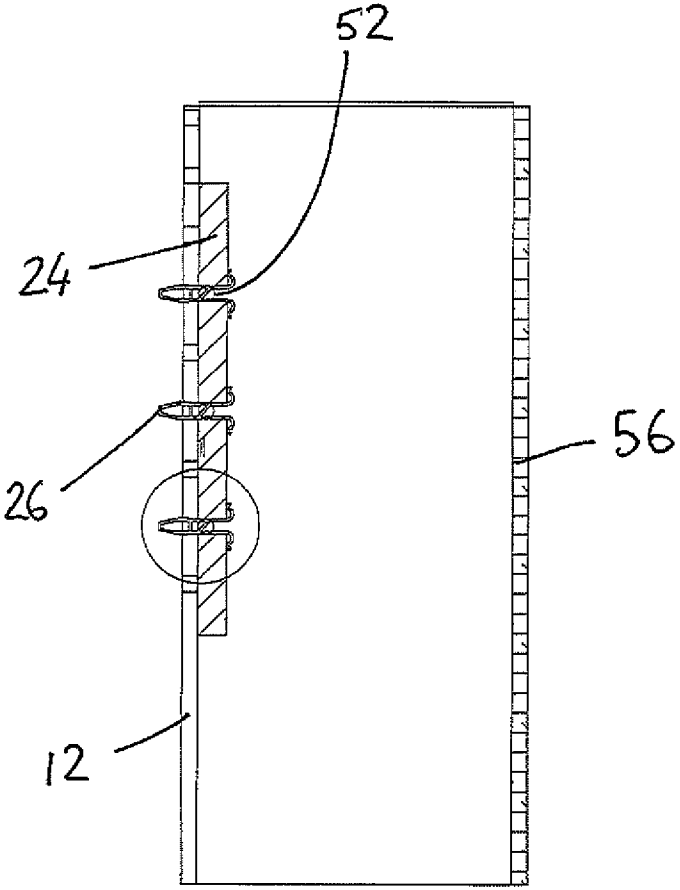
FIG. 3 is a diagrammatic cross sectional side view through the apparatus of FIG. 1.

The clip members 26 are made from a resilient plastics material and comprise upper and lower faces 28, 30, for instance as shown in FIGS. 4 and 5. The faces 28, 30 are parallel for a significant part of the clip members 26, but interconnect in a blunted point at a distal end 32, and provide a head 34 at a proximal end with a convex main portion 36 and outwardly curving end parts 38.

Spaced a short way from the blunted distal end 32 on each face 28, 30 is an engagement formation formed of a series of serrations 40 inclined towards the head 34. A first perpendicular web 42 extends between the upper and lower faces 28, 30 on the proximal side of the serrations 40. A second inclined web 44 extends between the upper and lower faces 28, 30 and is inclined towards the head 34 and the upper face 28, which inclined web 44 provides a significantly more rigid upper face 28 than the lower face 30, towards the proximal end of the clip members 26.

A frangible formation in the form of a partial cut 46 from each side is provided in the upper and lower faces 28, 30 to the proximal side of the inclined web 44, with the cuts 46 in the upper and lower faces 28, 30 opposite each other.

In use, the facing members 24 are located against the base member 12 which will generally be held in an upright orientation. The marking lines 20 help correctly locate the facing members 24. The facing members 24 are held on the base member 12 using the clip members 26, and FIG. 1 illustrates a conventional brick configuration with offset stretcher bricks 48, with half length header bricks 50 at each end as required.

Figure 2:
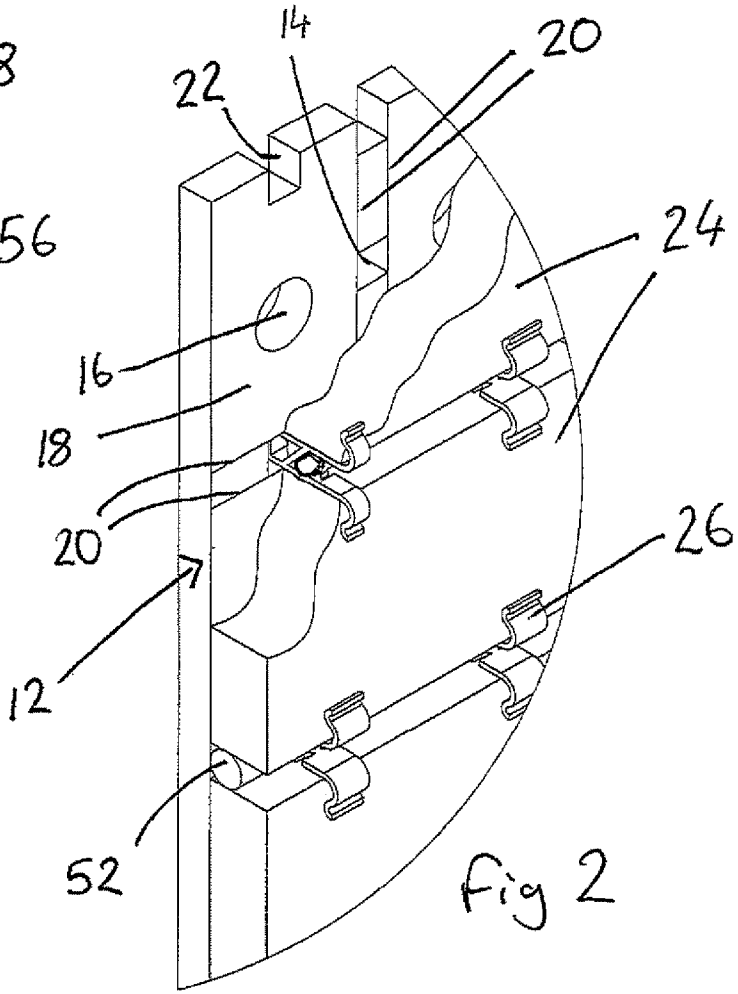
FIG. 2 is an enlarged part of FIG. 1.
Figure 1:
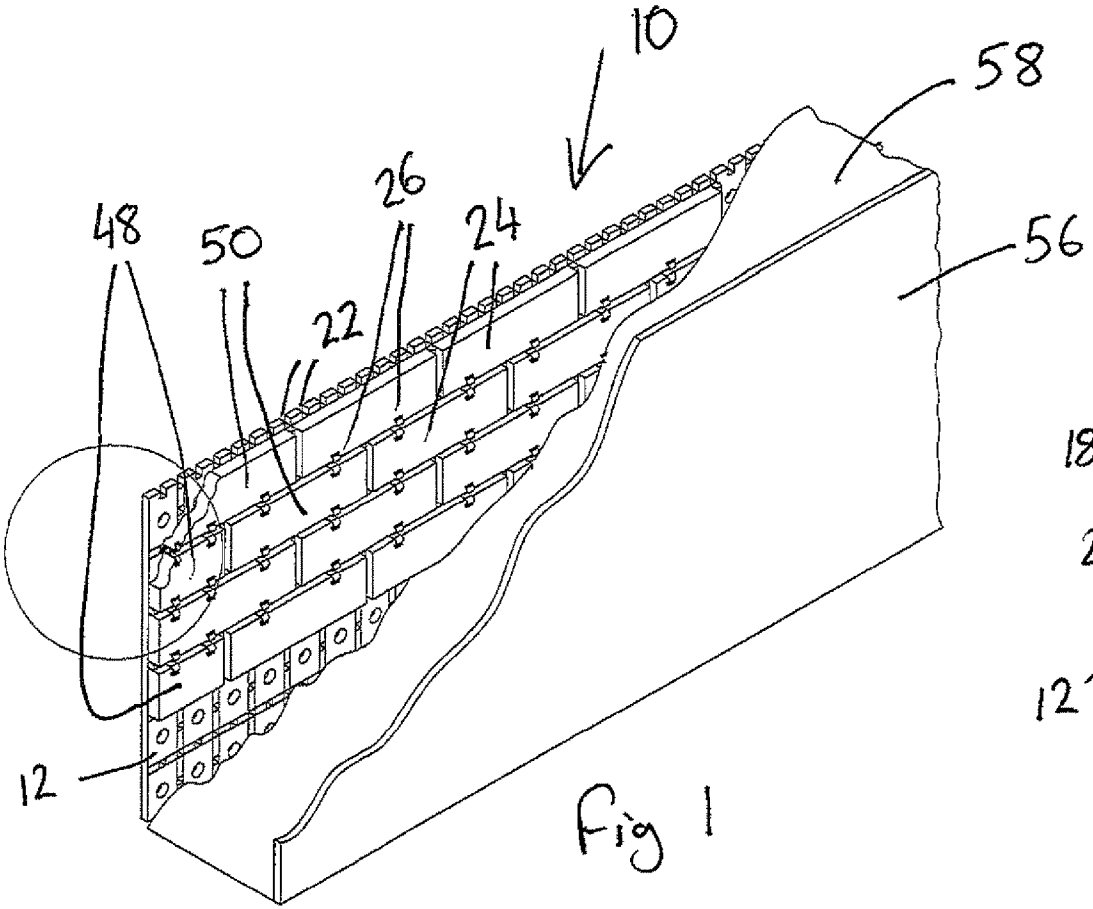
FIG. 1 is a diagrammatic partially cut away perspective view of apparatus according to the invention.

As can be seen in FIG. 1, for each stretcher brick 48 two clip members 26 are provided at the top and bottom, and with two more closely spaced clip members 26 top and bottom for the header bricks 50. The upper faces 28 of the clip members 26 are relatively rigid by virtue of the inclined web 44, thereby providing a datum to ensure a correct parallel alignment of the brick courses. The lower faces 30 of the clip members 26 which engages against the upper edges of the facing members 24, are more flexible by virtue of the inclined web 44, and this will allow for instance size tolerances in the facing members 24 occurring for instance during firing, to be accommodated.

With the facing members 24 in a required position, the clip members 26 are pushed into the respective facing member mounting holes 14 until tight, and the serrations 40 prevent the clip members 26 from being pulled back out of the facing member mounting holes 14. The spacing of the serrations 40 is such that the distance between the serrations 40 can be accommodated by flexing of the clip member head 34 against the facing members 24. The facing members 24 are therefore held in tension against the base member 12.

A sealing member 52 is then provided between the facing members 24 and pushed against the base member 12. The sealing member 52 is in the form of strips of a resilient circular section polyethylene. As can be seen for instance in FIG. 4 the diameter of the sealing member 52 is approximately half the thickness of the facing members 24, such that on the opposite side of the sealing member 52 to the base member 12, a space 54 is provided.

With all of the facing members provided to cover the base member 12, a mould is formed using mould members 56 which may be modular, with the base member 12 forming one face of the mould. In the drawings only a restricted number of the facing members 24 have been shown on the base member 12, but in practice the whole of the base member 12 is likely to be covered by facing members 24. If facing members are not required at any point, the corresponding facing member and mould mounting holes 14, 16 would require closing.

With the mould complete a settable material 58 such as concrete is poured or pumped into the mould space. The settable material 58 will fill the spaces 54 in between the facing members 24, but will not pass fully between the facing members 24. Once the settable material 58 is fully set the building component thus formed can be removed from the mould. The clip members 26 at this point will break at the frangible formations provided by the partial cuts 46, leaving part of the clip members 26 in the base member 12 which can readily be removed to permit use of the base member 12 in forming other building components. The other parts of the clip members 26 will be retained within the building component but will not be visible. Any necessary finishing work to the building component can then be carried out such as for instance pointing between the facing members 24.

Figure 7:
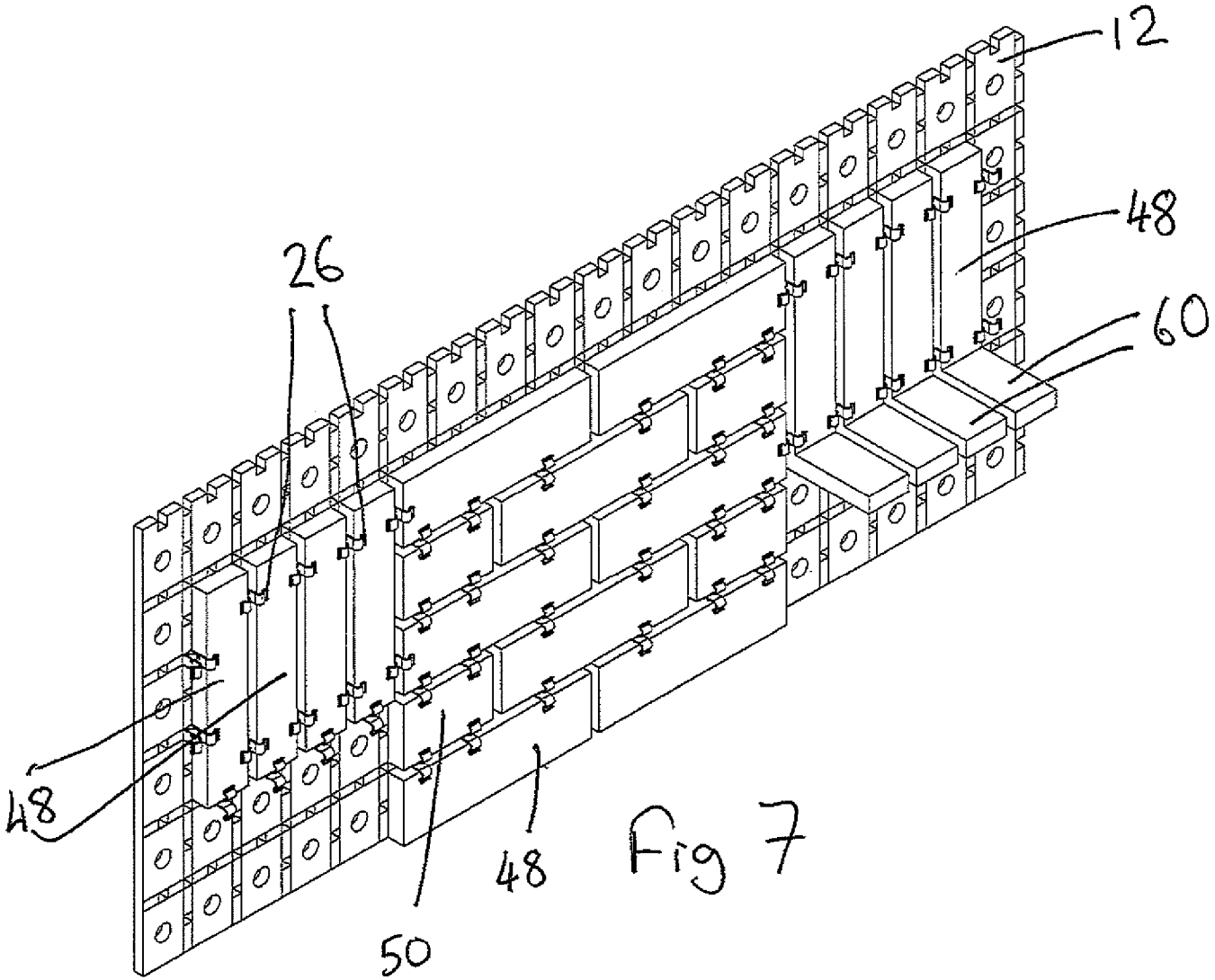
FIG. 7 is a diagrammatic perspective view of further apparatus according to the invention.

FIG. 7 by way of example illustrates other possible patterns of facing members, with a number of stretcher bricks 48 extending vertically, with two clip members 26 on each side, and one clip member 26 provided beneath. A number of brick facing members 60 are shown extending horizontally outwardly from the base member 12, and these would define for instance a space for a window or other opening or feature, and appropriate shuttering would be provided for these.

This apparatus and methods of using this apparatus, therefore provide for a number of significant advantages. The base member and array of facing member mounting holes mean that a wide range of required patterns of facing members can be provided as required. The array of facing member mounting holes and the clips mean that accurate required patterns of facing members can be achieved, and for instance accurate parallel rows of facing members can be provided. Whilst the clip members will be sacrificed for each building component made, the base member can be used for producing a large number of components, in contrast to conventional moulds which often cannot be reused to any significant degree.

The facing members are held securely on the base member by the clips such that sealing member can be urged strongly into the gaps therebetween.

If required the facing members can be soaked in water before casting of the component, without affecting formation of the component.

The base member is such that any other parts of the mould can be mounted thereto, and it is to be realised that such a base member could be used with other mould parts and/or similar base members to provide corners or other formations in a building component.

The provision of the sealing member, and the space provided therebehind ensures a good bond between the concrete and the facing members, but prevents the concrete from reaching the front face of the facing members. Therefore a clean building product which does not require significant subsequent operation is provided, and this can readily be pointed after moulding.

In an alternative arrangement, rather than providing the sealing members, a retarded grout could be provided between the facing members, still providing space therebehind to produce a strong bond between the concrete and the facing members. The retardation will be such that the grout will still not be fully cured after moulding of the building component, and can subsequently be reworked after removal of the component from the mould.

Figure 8:
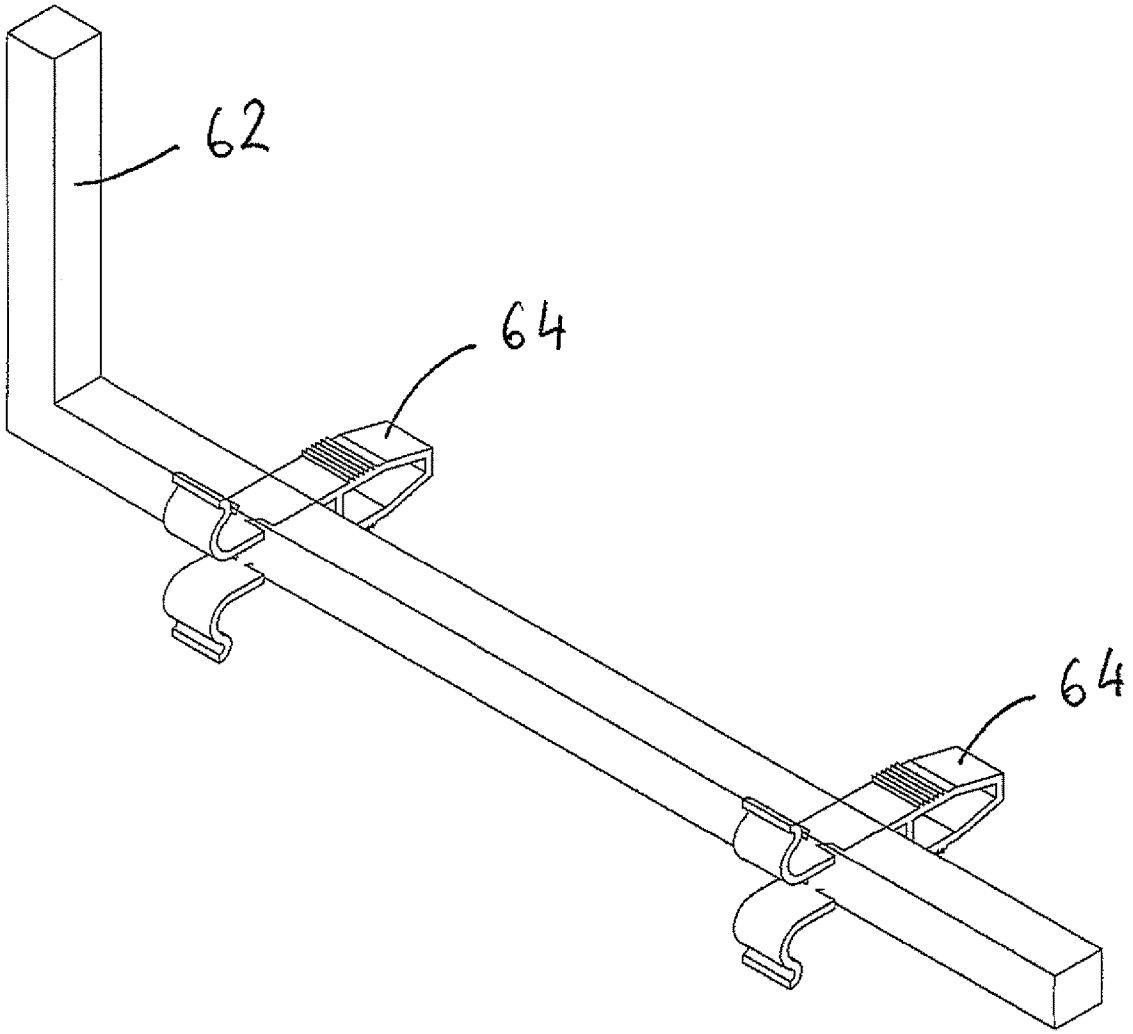
FIG. 8 is a diagrammatic perspective view of a further component usable in the invention.

A wide range of other modifications may be made without departing from the scope of the invention. For instance the clip members and sealing members could be integrally formed as shown in FIG. 8. In this instance a resilient sealing member 62 is provided which in this instance is a length of square section resilient polyethylene which would be of a size to require compression to locate between adjacent facing members. A pair of clip members 64 are mounted on the sealing member 62 at a required spacing, and could for instance be formed thereon by overmoulding.

The base member could be made of a different material and could take a different form. A different array of mounting holes could be provided, and the holes could be of a different shape. For instance the facing member mounting holes could be other than square and could perhaps be in the form of slots.

A wide range of other facing members can be used, including tiles, stones, brick slips or terracotta.

The clip members may take many different forms. The length of the clips will depend on the thickness of the facing members. Different formations such as for instance barbs could be provided to provide retention in the base member. Clip members with heads at different spacings from the body, and/or adjustable spacings from the body, to permit different thicknesses of facing members to be mounted adjacent each other.

Different frangible formations could be used such as lines of weakness. The head could take a different form and could for instance just include a single convex curve to ensure a good grip on the facing members. The apparatus could be used with settable materials other than concrete.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A method of forming a building component of a settable material, the method including:

mounting a plurality of facing members on a base member using an apparatus comprising:

a plurality of facing members provided on at least one face of the building component;

a base member which can form part of a mould, the base member being in the form of a sheet of material with a regular array of through holes; and a plurality of clip members each with a body engageable in a required one of the regular array of through holes to retain each respective clip member in position, each clip member also including a head engageable against a facing member to urge the facing member against the base member, and to hold the facing member in position in a mould whilst the settable material is located in the mould and sets, such that a building component is formed with the facing members attached to the settable material, wherein each clip member further includes first and second opposite support faces engageable against respective adjacent facing members, and wherein the first and second opposite support faces are provided by opposite spaced strips, with an interconnecting web;

forming a mould incorporating the base member;

locating a settable material in the mould; and removing the formed building component from the mould once the settable material has set, the removing including breaking the plurality of clip members extending between the facing members and the base member.

2. The method according to claim 1, further comprising providing a retarded mortar between the facing members adjacent the base member, wherein retardation of the mortar is such that the mortar will not fully cure until after setting of the settable material, such that the mortar can be worked further following settling of the settable material of the building component.

3. The method according to claim 1, wherein the building component includes at least one of reinforcement or insulation that is mounted to the plurality of clip members prior to location of the settable material in the mould.

4. The method according to claim 1, wherein the settable material is concrete.

5. The method according to claim 1, wherein the facing members are any of bricks, tiles, stones, brick slips or terracotta.

6. The method according to claim 1, wherein the base member extends vertically during at least one of mounting of the facing members thereon or locating of the settable material in the mould.

7. An apparatus usable in forming a building component of a settable material, comprising:

a plurality of facing members provided on at least one face of the building component;

a base member which can form part of a mould, the base member being in the form of a sheet of material with a regular array of through holes; and a plurality of clip members each with a body engageable in a required one of the regular array of through holes to retain each respective clip member in position, each clip member also including a head engageable against a facing member to urge the facing member against the base member, and to hold the facing member in position in a mould whilst the settable material is located in the mould and sets, such that a building component is formed with the facing members attached to the settable material, wherein each clip member further includes first and second opposite support faces engageable against respective adiacent facing members, and wherein the first and second opposite support faces are provided by opposite spaced strips, with an interconnecting web.

8. The apparatus according to claim 7, in which the base member includes a plurality of non-circular cross-sectional facing member mounting holes to receive a clip member bodies in a required orientation.

9. The apparatus according to claim 8, in which the base member mounting holes are rectangular in cross section, square in cross section, or in form of slots.

10. The apparatus according to claim 7, wherein a first support face of the first and second opposite support faces of a clip member is significantly more rigid than a second support face of the first and second opposite support faces, such that the first support face provides a datum for locating the respective adjacent facing members, and the second support face is configured to accommodate tolerances in a size of the respective adjacent facing members.

11. The apparatus according to claim 7, wherein a first support face of the first and second opposite support faces of a clip member is significantly more rigid than a second support face of the first and second opposite support faces, such that the first support face provides a datum for locating the respective adjacent facing members, and the second support face is configured to accommodate tolerances in a size of the respective adjacent facing members, and wherein the interconnecting web is inclined towards a clip member head and the first support face.

12. The apparatus according to claim 7, wherein a further interconnecting web is provided extending between the first and second opposite support faces.

13. The apparatus according to claim 12, wherein a first support face of the first and second opposite support faces of a clip member is significantly more rigid than a second support face of the first and second opposite support faces, such that the first support face provides a datum for locating the respective adjacent facing members, and the second support face is configured to accommodate tolerances in a size of the respective adjacent facing members, and wherein the interconnecting web is inclined towards a clip member head and the first support face and the further interconnecting web is on an opposite side of the inclined interconnecting web to the clip member head.

14. The apparatus according to claim 11, wherein the clip member head is resilient.

15. The apparatus according to claim 14, wherein the clip member head is curved.

16. The apparatus according to claim 15, wherein the clip member head is configured to flatten out against the respective adjacent facing members when the clip member is urged into the base member.

17. The apparatus according to claim 14, wherein the clip member head extends outwardly respectively from each of the first and second opposite support faces.

18. The apparatus according to claim 7, wherein each of one or more clip members are formed with a corresponding head that is at least one of ata different spacing from a corresponding body or at an adjustable spacing from the corresponding body, to permit different thicknesses of corresponding facing members to be mounted adjacent each other.

19. The apparatus according to claim 7, wherein a clip member body of a clip member includes one or more engagement formations engageable against the base member to retain the clip member on the base member.

20. The apparatus according to claim 19, wherein the clip member includes a plurality of engagement formations that provide retaining of the clip member at a required position on the base member.

21. The apparatus according to claim 20, wherein spacing of the engagement formations is such that the head of the clip member is configured to flex to a greater extent against a facing member as the clip member is moved into the base member than the spacing.

22. The apparatus according to claim 20, wherein the engagement formations are in form of serrations or barbs.

23. The apparatus according to claim 7, wherein each clip member includes a frangible formation such that following setting of the settable material, each clip member is configured to break to release the building component from the base member.

24. The apparatus according to claim 23, wherein the frangible formation is in the form of a partial cut or a line of weakness, extending across the clip member.

25. The apparatus according to claim 24, wherein the frangible formation extends across the first and second opposite support faces spaced from the head of the clip member.

26. The apparatus according to claim 7, in which a sealing member is provided extendable between the facing members adjacent the base member, to prevent a settable material from passing between the facing members.

27. The apparatus according to claim 26, wherein the sealing member is of a lesser thickness than a depth of the facing members.

28. The apparatus according to claim 26, wherein the sealing member is in the form of a resilient elongate member which in a relaxed condition is wider than a spacing between formations, but compressible to locate between the facing members in a friction fit.

29. The apparatus according to claim 28, wherein the sealing member is made of polyethylene.

30. The apparatus according to claim 28, wherein the sealing member is circular in cross section.

31. The apparatus according to claim 26, wherein at least some of the plurality of clip members and the sealing member are integrally formed.

32. The apparatus according to claim 7, wherein the base member includes visible markings to assist correct location of the facing members thereon.

33. The apparatus according to claim 7, wherein the base member is in the form of a steel plate.

34. The apparatus according to claim 7, wherein the base member includes a plurality of mould mounting holes.

35. The apparatus according to claim 34, wherein the mould mounting holes are circular in cross section.

36. The apparatus according to claim 34, wherein the mould mounting holes are larger than the facing member mounting holes.

37. The apparatus according to claim 34, wherein the mould mounting holes are located between and spaced from the facing member mounting holes.

38. The apparatus according to claim 7, wherein the apparatus includes one or more mould members connectable to the base member to define a mould for the settable material to be located in, with the base member defining at least one face of the mould.

39. The apparatus according to claim 38, wherein the mould members are modular.

40. The apparatus according to claim 38, wherein one or more connecting bars extend between the mould members and the base member.

41. The apparatus according to claim 38, wherein the base member includes a plurality of mould mounting holes, and wherein at least one of the mould members or connecting bars are mountable to the mould mounting holes of the base member.

42. The apparatus according to claim 7, wherein the plurality of clip members include formations to mount reinforcement and/or insulation or other components, such that these can be located within the building component.

* * * * *